US008973675B2

(12) United States Patent
Herrera

(10) Patent No.: US 8,973,675 B2
(45) Date of Patent: Mar. 10, 2015

(54) FLASKED PRESSURE HOUSING

(75) Inventor: Adan Hernandez Herrera, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 62 days.

(21) Appl. No.: 13/255,570

(22) PCT Filed: Mar. 3, 2010

(86) PCT No.: PCT/US2010/026060
§ 371 (c)(1),
(2), (4) Date: Oct. 5, 2011

(87) PCT Pub. No.: WO2010/104716
PCT Pub. Date: Sep. 16, 2010

(65) Prior Publication Data

US 2012/0018230 A1 Jan. 26, 2012

Related U.S. Application Data

(60) Provisional application No. 61/159,329, filed on Mar. 11, 2009.

(51) Int. Cl.
*E21B 17/00* (2006.01)
*E21B 33/038* (2006.01)
*E21B 47/01* (2012.01)

(52) U.S. Cl.
CPC ..... *E21B 33/038* (2013.01); *E21B 47/011* (2013.01)
USPC ..... 175/40; 175/50; 175/325.2; 361/708; 361/715; 361/600; 361/679.1

(58) Field of Classification Search
CPC ..... E21B 47/011; G01V 5/04
USPC ..... 166/65, 1, 302, 57, 250.11, 162; 361/715, 708, 600, 679.01; 175/40, 50
See application file for complete search history.

(56) References Cited

U.S. PATENT DOCUMENTS

| | | | | |
|---|---|---|---|---|
| 2,824,233 | A * | 2/1958 | Herzog | 250/261 |
| 2,902,603 | A * | 9/1959 | Ferre | 250/368 |
| 3,149,230 | A * | 9/1964 | Hall, Jr. | 250/268 |
| 5,547,028 | A | 8/1996 | Owens et al. | |

(Continued)

OTHER PUBLICATIONS

J. P. Nguyen "Drilling—Oil and Gas Field Development Techniques", Technip, 1996.*

(Continued)

*Primary Examiner* — Jennifer H Gay
*Assistant Examiner* — George Gray

(57) ABSTRACT

A system for containing electronics positioned in a downhole tubular. The system includes a pressure housing, a rigid end piece, a compliant end piece, an inner tubular member, one or more annular standoffs, and a chassis. The pressure housing is supported within the downhole tubular. The rigid end piece and the compliant end piece are fixedly coupled within opposing ends of the pressure housing. The inner tubular member is disposed within the pressure housing and has opposing ends. One of the opposing ends is coupled to the rigid end piece, and the other of the opposing ends is free to move relative to the compliant end piece. The chassis is disposed within the inner tubular member and houses the electronics. Each standoff is disposed between the inner tubular member and the pressure housing and includes at least one radially extending portion compressed therebetween.

20 Claims, 5 Drawing Sheets

(56) References Cited

U.S. PATENT DOCUMENTS

| | | | |
|---|---|---|---|
| 7,440,283 | B1 | 10/2008 | Rafie |
| 2006/0108116 | A1 | 5/2006 | Morys et al. |
| 2007/0095543 | A1 | 5/2007 | Tchakarov et al. |
| 2010/0147523 | A1 * | 6/2010 | DiFoggio ..... 166/302 |

OTHER PUBLICATIONS

PCT/US2010/026060 International Search Report and Written Opinion, Jul. 28, 2010 (9 p.).

* cited by examiner

FLASKED PRESSURE HOUSING

STATEMENT REGARDING FEDERALLY SPONSORED RESEARCH OR DEVELOPMENT

Not Applicable.

BACKGROUND

To form an oil or gas well, a bottom hole assembly (BHA), including components such as a motor, steering assembly, one or more drill collars, and a drill bit, are coupled to a length of drill pipe to form a drill string. Tools including electronic instrumentation are typically positioned on the BHA to obtain measurements of the downhole environment while drilling. Once assembled, the drill string is then inserted downhole, where drilling and data collection by the tools commence.

The downhole tools and their associated electronic instrumentation must be able to operate near the surface as well as many thousands of feet below. Since temperature within a wellbore tends to increase with increasing depth, the tools may be subjected to severe thermal loads, depending on the depth of the wellbore. Moreover, during drilling, the tools experience vibrational loads due to operation of the drill bit and pressure loads from drilling mud passing through and around the drill string. In some circumstances, the tools are exposed to wellbore temperatures and pressures exceeding 200° C. (473° K) and 20,000 psi (approximately 138,000 kPa).

The maximum operating temperature limit of electronic instrumentation in the downhole tools can be significantly less than the surrounding wellbore temperature, depending on wellbore depth, and may be no more than 125° C. (398° K). As a consequence, prolonged exposure of the downhole tools to the severe thermal environment of the wellbore may cause the temperatures of the electronic instrumentation to exceed their maximum operating limit, thereby resulting in reduced service life and perhaps failure of the tools.

Servicing or replacement of the downhole tools necessitates the drill string be pulled from the wellbore. Once the tools are repaired or replaced, the drill string is then run into the wellbore again, and drilling may resume. Given the costs associated with interrupting drilling and pulling the drill string from the wellbore, apparatus which prolong the service life of electronic instrumentation included within the downhole tools are particularly desirable.

SUMMARY

A system for containing electronics positioned in a downhole tubular is disclosed. In some embodiments, the system includes a pressure housing, a rigid end piece, a compliant end piece, an inner tubular member, one or more annular standoffs, and a chassis. The pressure housing is supported within the downhole tubular. The rigid end piece and the compliant end piece are fixedly coupled within opposing ends of the pressure housing. The inner tubular member is disposed within the pressure housing and has opposing ends. One of the opposing ends is coupled to the rigid end piece, and the other of the opposing ends is free to move relative to the compliant end piece. The chassis is disposed within the inner tubular member and houses the electronics. Each standoff is disposed between the inner tubular member and the pressure housing and includes at least one radially extending portion compressed therebetween.

In other embodiments, the system includes a pressure housing supported within the downhole tubular, a rigid end piece, a compliant end piece, a thin-walled tubular member, and a chassis. The rigid end piece and the compliant end piece are sealingly engaged within opposing ends of the pressure housing. The tubular member is disposed within the pressure housing and has opposing ends. One of the opposing ends is sealingly engaged with the rigid end piece, and the other of the opposing ends is sealingly engaged with the compliant end piece. The chassis is disposed within the tubular member and houses the electronics.

Further, some system embodiments include a drill string suspended into a wellbore, a drill collar positioned within the drill string, the drill collar including a bore through which a drilling fluid flows, a mounting plate disposed within the bore of the drill collar; and a flasked pressure housing coupled to the mounting plate and suspended within the bore of the drill collar. The flasked pressure housing includes an outer housing, a rigid end piece, a compliant end piece, a thin-walled inner tubular member, one or more annular standoffs, and a chassis. The rigid end piece and the compliant end piece are fixedly coupled within opposing ends of the outer housing. The inner tubular member is disposed within the outer housing and has opposing ends. One of the opposing ends is coupled to and in sealing engagement with the rigid end piece. The other of the opposing ends is sealingly engaged with the compliant end but free to move relative to the compliant end piece. The chassis is disposed within the inner tubular member and houses electronics. Each standoff includes at least one radially extending portion compressed between the inner tubular member and the outer housing.

Thus, embodiments described herein comprise a combination of features and characteristics intended to address various shortcomings associated with certain prior devices and systems. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a more detailed description of the disclosed embodiments, reference will now be made to the accompanying drawings, wherein.

DETAILED DESCRIPTION OF THE DISCLOSED EMBODIMENTS

Figure 1:
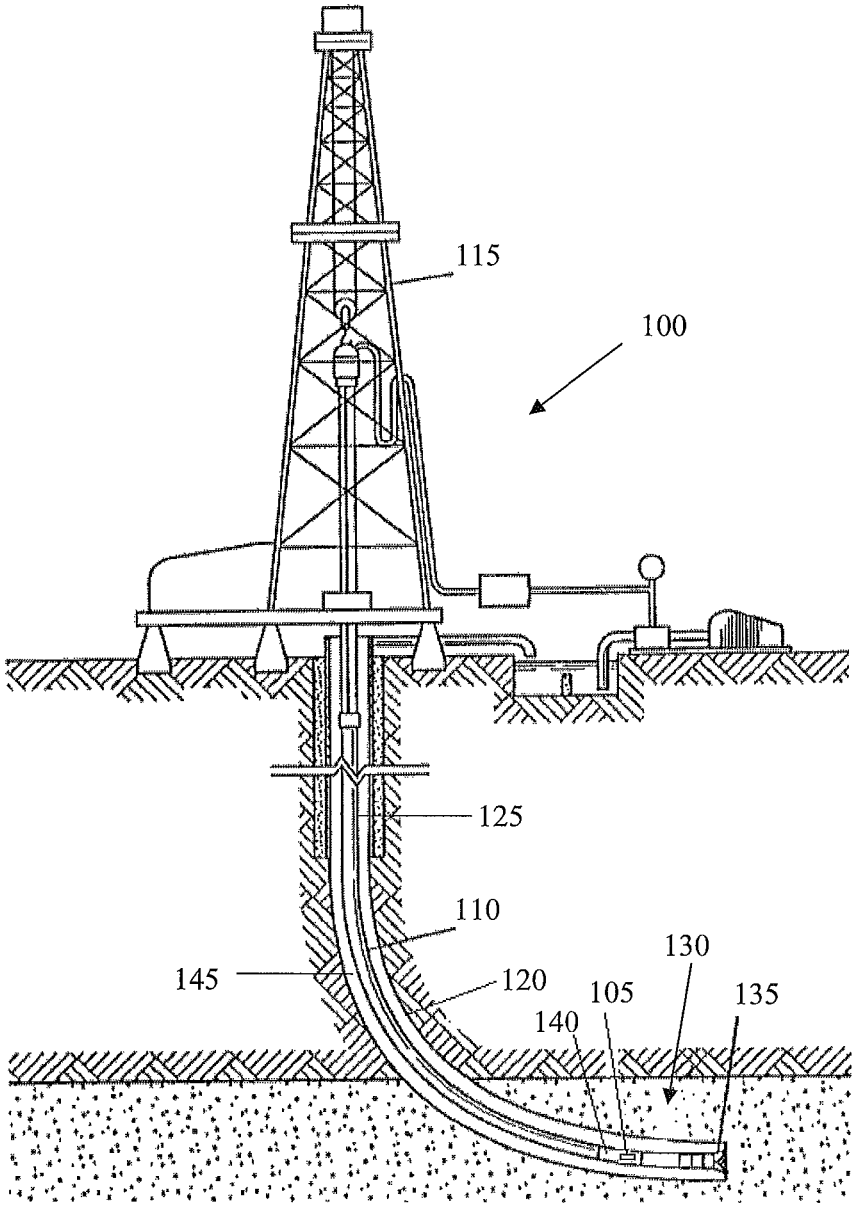
FIG. 1 is a cross-sectional view of a drilling system with a flasked pressure housing in accordance with the principles disclosed herein.

Referring to FIG. 1, a drilling system 100 including a flasked pressure housing, or flask, 105 in accordance with the principles disclosed herein is depicted. Drilling system 100 further includes a drill string 110 suspended from a rig 115 into a wellbore 120. Drill string 110 includes a plurality of drill pipe sections 125, to which a BHA 130 is coupled. BHA 130 includes a drill bit 135 and a drill collar 140 within which flask 105 is disposed. Drill collar 140 is a thick-walled tubular that provides weight on drill bit 135 for drilling. BHA 130 may include other components, such as but not limited to a drill sub, a motor, a steering assembly, a stabilizer, and additional drill collars. During drilling, drilling fluid, or "drilling mud," is circulated down through drill string 110 to lubricate and cool drill bit 135, as well as to provide a vehicle for removal of drill cuttings from wellbore 120. After exiting drill bit 135, the drilling fluid returns to the surface through an annulus 145 between drill string 110 and wellbore 120.

In this embodiment, rig 115 is land-based. In other embodiments, flask 105 may be positioned within a drill string suspended from a rig on a floating platform. Moreover, flask 105 may be positioned within other tubulars positioned in drill string 110, rather than drill collar 140. Furthermore, flask 105 need not be disposed in a drill string, as illustrated by this embodiment, but may be positioned within a downhole tubular suspended by wireline, coiled tubing, or other similar device.

Figure 2:
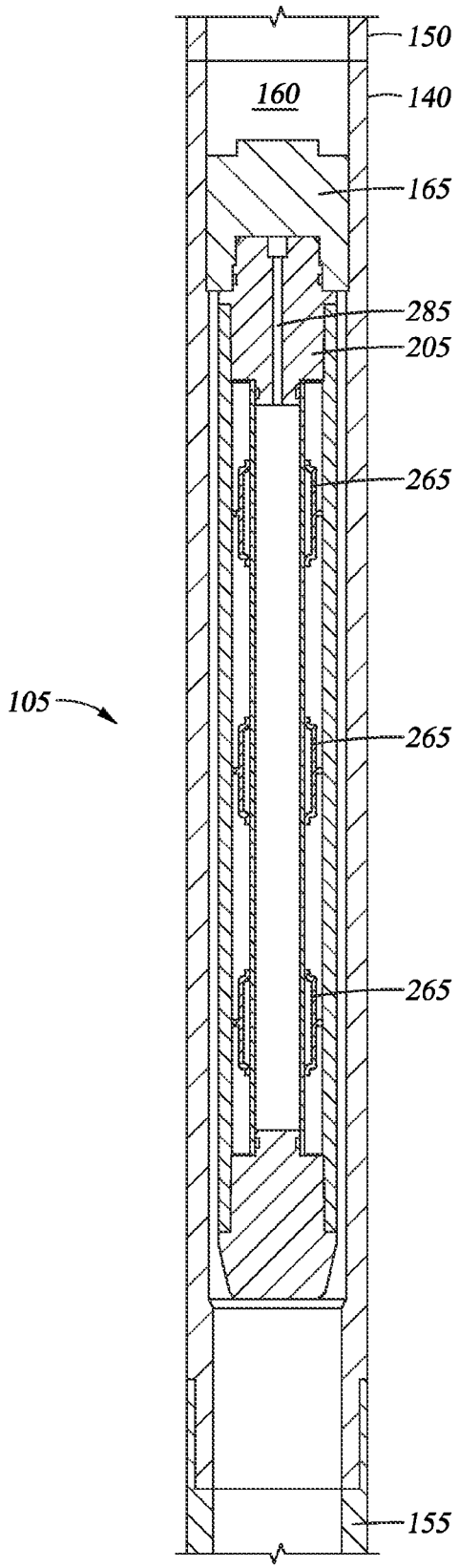
FIG. 2 is an enlarged, cross-sectional view of the flasked pressure housing mounted within a drill collar of the drilling system of FIG. 1.

Referring next to FIG. 2, an enlarged view of drill collar 140 with flask 105 mounted therein is shown. Drill collar 140 is structurally coupled between two adjacent components 150, 155 of drill string 110 positioned uphole and downhole, respectively, of drill collar 140. In some embodiments, including that illustrated by FIG. 2, component 150 is a section of drill pipe 125, and component 155 is a stabilizer for controlling the trajectory of drill bit 135 as drilling progresses. Drill collar 140 includes a flowbore 160 extending therethrough. Flowbore 160 is fluidicly coupled with components 150, 155 to enable the flow of drilling mud from the surface through drill string 110 to drill bit 135.

Flask 105 is disposed within flowbore 160 and structurally coupled to drill collar 140 via a mounting plate 165, such that mounting plate 165 suspends flask 105 within flowbore 160. Drilling mud passing through drill collar 140 flows through openings (not shown in the illustrated cross-section) in mounting plate 165 and around flask 105, substantially uninhibited by either mounting plate 165 or flask 105. Further, flask 105 is electrically coupled to electrical wiring (not shown) extending through drill pipe section 150 to enable transmission of power from a source positioned on drill string 110 and/or the surface to flask 105, and transmission of measurements collected by electronics disposed within flask 105 to the surface and/or a data storage device positioned on drill string 110.

During drilling operations, drilling mud is injected from the surface through drill string 110, including drill collar 140, to cool drill bit 135. As the drilling fluid flows through flowbore 160 of drill collar 140 around flask 105 toward drill bit 135, the drilling mud exerts a pressure load on flask 105. The pressure load so exerted is dependent upon the depth of wellbore 120, and can be in excess of 20,000 psi (approximately 138,000 kPa). In addition to the pressure load, flask 105 experiences vibrational loads, which during drilling operations, propagate from drill bit 135 along BHA 130 through drill collar 140 and mounting plate 165 to flask 105. Flask 105 also experiences thermal loads due to the high temperature of the surrounding wellbore environment. As will be described, flask 105 is configured to withstand the pressure and vibrational loads and to insulate the electronics disposed therein from the potentially excessive thermal load.

Figure 3:
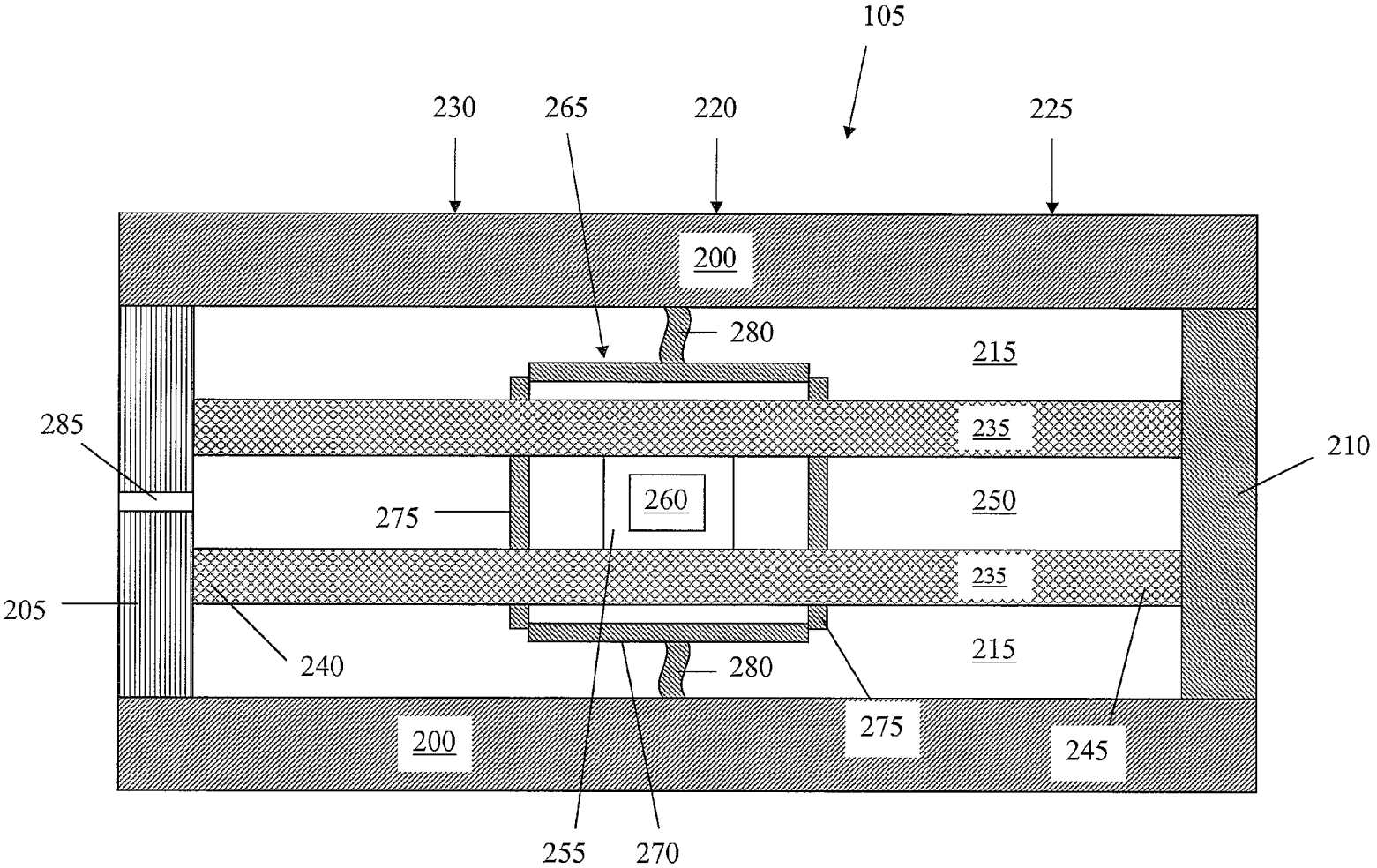
FIG. 3 is a cross-sectional view of the flasked pressure housing of FIG. 2.

Turning to FIG. 3, a cross-section of flask 105 is shown. Flask 105 includes a tubular outer pressure housing 200 sealed at one end with a rigid end piece 205 and at the other end with a compliant end piece 210. End pieces 205, 210 are coupled to outer pressure housing 200 such that when outer pressure housing 200 elongates due to exposure to a thermal load 220 from the surrounding wellbore 120 and subsequently contracts due to the removal or reduction of thermal load 220, end pieces 205, 210 displace with outer pressure housing 200. In some embodiments, end pieces 205, 210 are welded to, or threaded into, outer pressure housing 200. The thickness of outer pressure housing 200 is selected to withstand a pressure load 225 from drilling mud passing through drill collar 140 and a vibrational load 230 imparted to outer pressure housing 200 by virtue of its structural coupling to drill collar 140 via mounting plate 165. In at least some embodiments, outer pressure housing 200 is made of a material having a yield strength of at least 120,000 psi (approximately 827,500 kPa), such as but not limited to nickel 718 or austenitic stainless, and has a thickness of ¼ of an inch (approximately 6.35 mm).

Flask 105 further includes an inner tubular 235 disposed within outer pressure housing 200 and extending longitudinally, or axially, between end pieces 205, 210. Inner tubular 235 is coupled at one end to either rigid end piece 205 or compliant end piece 210, and therefore outer pressure housing 200, such as by welding or other equivalent means. The other end of inner tubular 235 is not coupled to the opposing end piece 205, 210, and therefore outer pressure housing 200, but is free to move relative to outer pressure housing 200. Allowing one end of inner tubular 235 to remain uncoupled from outer pressure housing 200 eliminates the transfer of tensile and compressive loads from outer pressure housing 200 to inner tubular 235 as outer pressure housing 200 elongates and contracts in response to changes in thermal load 220. In this embodiment, end 240 of inner tubular 235 is coupled to rigid end piece 205, while end 245 of inner tubular 235 remains uncoupled to compliant end piece 210 and hence is free to move relative to outer pressure housing 200.

Inner tubular 235 further includes an inner bore 250 within which one or more chassis 255 are inserted. In FIG. 3, only one chassis 255 is shown for the sake of simplicity, although in practice, there may be more. Electronics 260, such as but not limited to instruments and sensors for measuring downhole conditions, are mounted within each chassis 255. Ends 240, 245 of inner tubular 235 are sealed with respect to end pieces 205, 210, respectively, to isolate bore 250 containing chassis 255 and electronics 260 mounted therein from a chamber 215 formed by the sealed annulus between outer pressure housing 200 and inner tubular 235.

As previously described, flask 105 is subjected to thermal load 220 from the surrounding wellbore environment. To minimize convective heat transfer from outer pressure housing 200 to inner tubular 235, a vacuum is pulled on chamber 215 via one or more sealable ports 285 formed in rigid end piece 205. Minimizing this source of heat to inner tubular 235 reduces the amount of heat which is subsequently transferred via conduction from inner tubular 235 through chassis 255 to electronics 260 and thus assists electronics 260 in remaining within its operational temperature limits.

Figure 4:
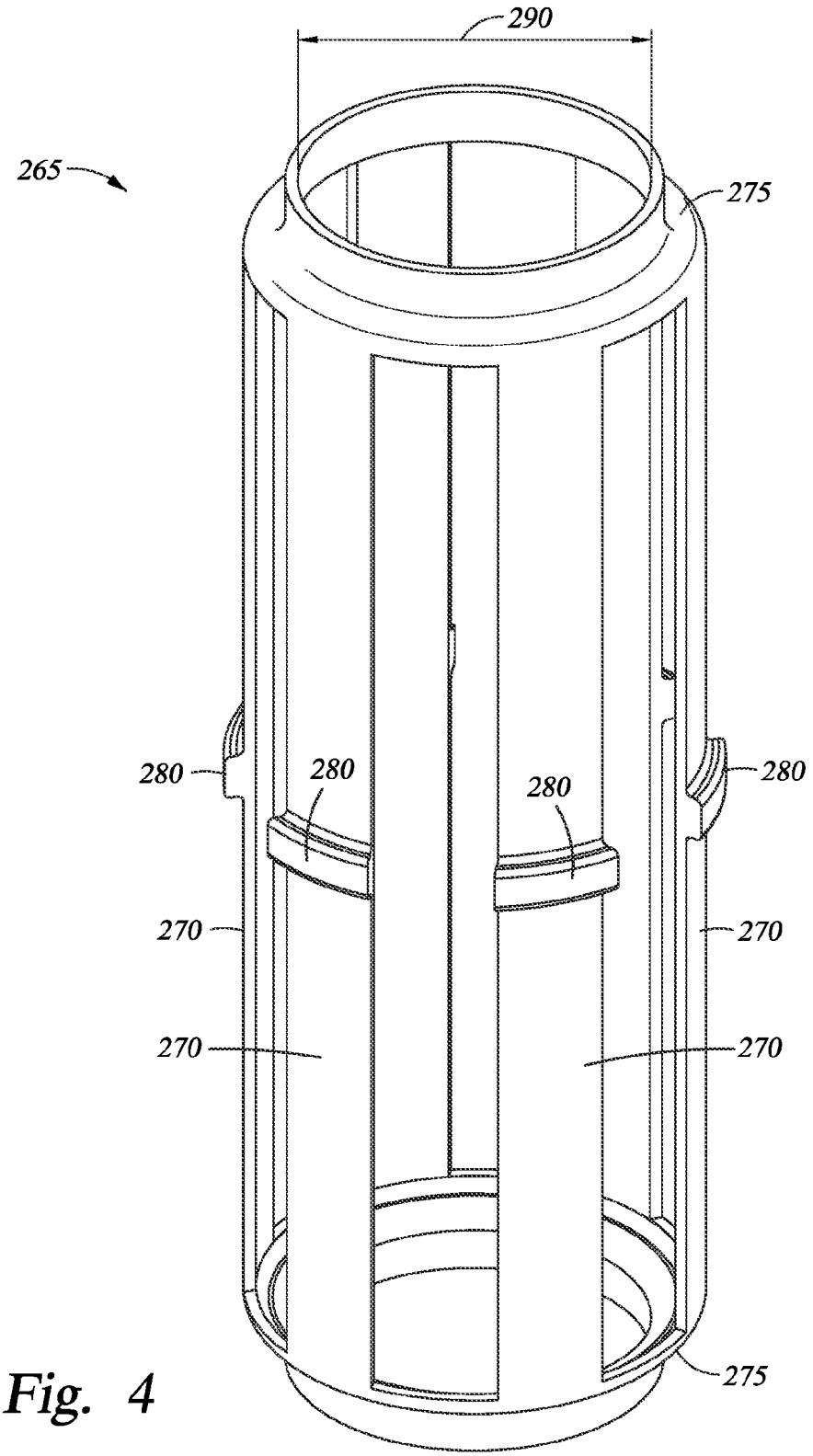
FIG. 4 is a perspective view of the collet standoff of the flasked pressure housing of FIG. 3.

Flask 105 further includes one or more collet standoffs 265 disposed between inner tubular 235 and outer pressure housing 200 and extending longitudinally between end pieces 205, 210. In FIG. 2, three collet standoffs 265 are shown within flask 105, while in FIG. 3, only one is shown for simplicity. Turning to FIG. 4, collet standoff 265 includes a plurality of support members 270 extending longitudinally between two end coupling members 275 and a plurality of standoffs 280, each standoff 280 extending radially outward from a support member 270. Standoffs 280 may be formed as components distinct from support members 270 and subsequently coupled thereto or formed integrally with a support member 270. Each end coupling member 275 is annular and has an inner diameter 290 configured to allow inner tubular 235 to extend therethrough, such that ends 240, 245 of inner tubular 235 are proximate end pieces 205, 210, respectively, as described above and shown in FIG. 3. Referring to FIG. 3, collet standoff 265 is configured such that when inner tubular 235 is inserted therethrough and collet standoff 265 with inner tubular 235 therein is subsequently inserted within outer pressure housing 200, as shown, radially extending standoffs 280 are compressed between outer pressure housing 200 and support members 270 of collet standoff 265, and end coupling members 275 essentially support and centralize inner tubular 235 within collet standoff 265. As a result, inner tubular 235 and outer pressure housing 200 effectively move together as a single unit in response to vibration load 230.

Figure 5:
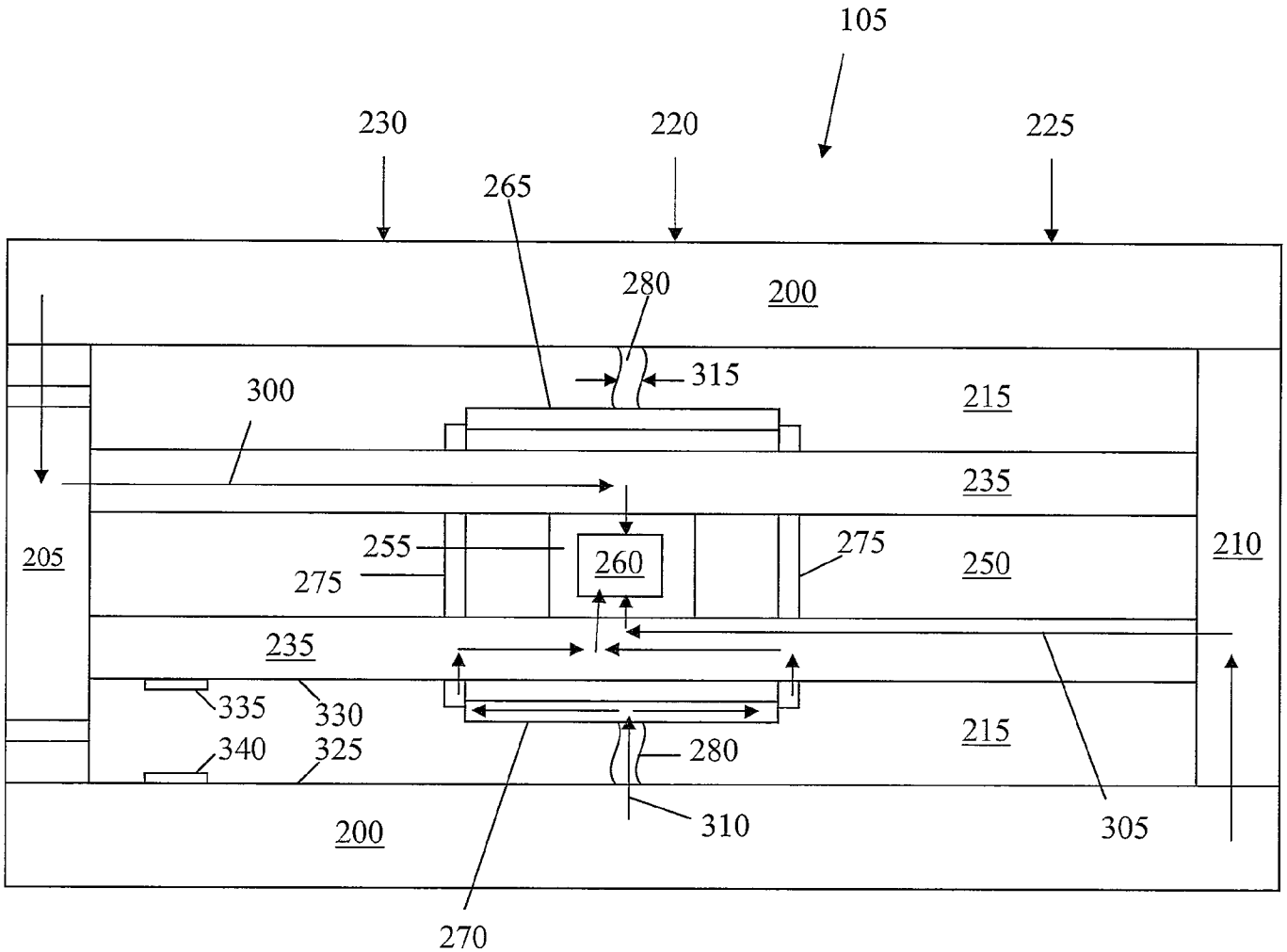
FIG. 5 is a schematic representation of conductive heat transfer paths between the outer pressure housing and the electronics disposed within the inner tubular of FIG. 3.

By virtue of the design of flask 105, there are a number of paths 300, 305, 310, illustrated in FIG. 5, along which heat may be conducted from outer pressure housing 200, which is subject to thermal load 225 from the surrounding wellbore environment, to electronics 260 disposed within inner tubular 235. In accordance with the principles disclosed herein, flask 105 is configured to minimize conductive heat transfer along each such path 300, 305, 310. By virtue of contact between adjacent components, heat may be conducted from outer pressure housing 200 to electronics 260 along paths 300, 305, which extend from outer pressure housing 200 through end pieces 205, 210, respectively, inner tubular 235, and chassis 255 to electronics 260. To minimize conductive heat transfer along these paths 300, 305, inner tubular 235 is configured to be thin-walled, meaning the wall thickness of inner tubular 235 is no thicker than necessary to withstand mechanical loads imparted to inner tubular 235 and to support chassis 255 with electronics 260 disposed therein. In some embodiments, the thickness of inner tubular 235 is approximately 0.05 inches (approximately 1.27 mm).

Heat may also be conducted along path 310 from outer pressure housing 200 through each standoff 280 and support member 270 coupled thereto of collet standoff 265, inner tubular 235, and chassis 255 to electronics 260. To minimize the amount of heat conducted along these paths 320, the number of standoffs 280 is selected to be no greater than necessary to withstand mechanical loads imparted to collet standoff 265 while still supporting inner tubular 235 disposed therein. Moreover, each standoff 280 is configured to have a minimal cross-section in engagement with outer pressure housing 200.

In some embodiments, collet standoff 265 is configured to support two $lb_f$ (approximately 8.9 N) over every foot (approximately 0.3 in) of its length. To accommodate this strength requirement while at the same minimizing heat conduction along paths 320, collet standoff 265 is made of titanium due to its strength and relatively moderate thermal conductivity. Moreover, the axial spacing between adjacent standoffs 280 is approximately six inches (approximately 152 mm).

Heat may also be transferred from outer pressure housing 200 to inner tubular 235 by radiative heat exchange between the inner surface 325 of outer pressure housing 200 and the outer surface 330 of inner tubular 235. To reduce or minimize this source of heat to inner tubular 235, surface 330 of inner tubular 235 may be coated with a material 335 to promote reflection of heat radiated from outer pressure housing 200. Alternatively, or additionally, surface 325 may be coated with a material 340 to reduce the amount of heat radiated from outer pressure housing 200.

To assemble flask 105, electronics 260 are disposed within one or more chassis 255, which, in turn, are then inserted within inner tubular 235. Inner tubular 235 is next inserted within outer pressure housing 200, and end 240 of inner tubular 235 is coupled to rigid end piece 205. One or more collet standoffs 265 are then inserted between inner tubular 235 and outer pressure housing 200 at desired locations along the length of inner tubular 235. Timer tubular 235 is then sealed at both ends 240, 245 with respect to end pieces 205, 210, respectively, to isolate bore 250. Ends 205, 210 are coupled to and sealingly engaged with pressure housing 200 such that ends 205, 210 also sealingly engage pressure housing 200 and chamber 215 is isolated from the atmosphere surrounding flask 105. To complete assembly of flask 105, a vacuum is pulled on chamber 215 between inner tubular 235 and outer pressure housing 200.

Once assembled, flask 105 is then mounted within drill collar 140 via mounting plate 165. Finally, electronics 260 within inner tubular 235 are electrically coupled to electrical wiring extending from drill pipe section 150, so that power may be supplied to electronics 260 and any measurements taken by electronics 260 may be transmitted to the surface and/or a storage location on drill string 110. When drill string 110 is fully assembled, drill string 110 is suspended from rig 115 and used to create wellbore 120.

During drilling operations, drilling fluid is delivered through drill string 110, including flowbore 160 of drill collar 140, to drill bit 135. Upon exiting drill bit 135, the drilling fluid returns to the surface via annulus 145 between drill string 110 and wellbore 120. As drilling operations progress, electronics 260 may be actuated to collect measurements and transmit collected data to the surface and/or a storage device positioned on drill string 110. As electronics 260 perform their intended functions, flask 105 protects electronics 260 from pressure load 225 exerted by the drilling mud on outer pressure housing 200, vibration loads 230 propagated from drill bit 135 to outer pressure housing 200 by way of mounting plate 165, and thermal loads 220 from the surrounding wellbore environment. Thus, flask 105 assists electronics 260 to remain intact and below their operational temperature limits so that electronics 260 are able to collect measurements and perform other of their intended functions while positioned downhole and exposed to the surrounding wellbore environment.

While the preferred embodiment of this invention has been shown and described, modifications thereof can be made by one skilled in the art without departing from the scope or teaching of this invention. The embodiments described herein are exemplary only and are not limiting. Many variations and modifications of the system and apparatus are possible and are within the scope of the invention. For example, the relative dimensions of various parts, the materials from which the various parts are made, and other parameters can be varied, so long as the methods and apparatus retain the advantages discussed herein. Accordingly, the scope of protection is not limited to the embodiments described herein, but is only limited by the claims that follow, the scope of which shall include all equivalents of the subject matter of the claims.

What is claimed is:

1. A system for containing electronics positioned in a downhole tubular, the system comprising:

a pressure housing supported within the downhole tubular;

a rigid end piece and a compliant end piece, each fixedly coupled within opposing ends of the pressure housing;

an inner tubular member disposed within the pressure housing, the inner tubular member including opposing ends, wherein one of the opposing ends is coupled to the rigid end piece and the other of the opposing ends is free to move relative to the compliant end piece;

one or more annular standoffs disposed between the inner tubular member and the pressure housing, each standoff including at least one radially extending portion contacting the pressure housing, and a gap between the radially extending portion and the inner tubular member; and a chassis disposed within the inner tubular member, the chassis housing the electronics.

2. The system of claim 1, wherein the at least one radially extending portion comprises a compliant material.

3. The system of claim 1, wherein each standoff further comprises:

two annular ends; and a plurality of longitudinally extending support member extending between the annular ends;

wherein the at least one radially extending portion extends from one or more of the support members.

4. The system of claim 3, wherein each of the annular ends has a bore through which the inner tubular member extends, whereby the standoff supports the inner tubular member.

5. The system of claim 1, wherein the pressure housing has a wall thickness operable to resist an external pressure load of at least 20,000 psi.

6. The system of claim 5, wherein the wall thickness is approximately 0.25 inches and the pressure housing comprises a material having a yield strength of at least 120,000 psi.

7. The system of claim 1, wherein the downhole tubular is a drill collar positioned on a drill string.

8. A system for containing electronics positioned in a downhole tubular, the system comprising:

a pressure housing supported within the downhole tubular;

a rigid end piece and a compliant end piece, each sealingly engaged within opposing ends of the pressure housing;

a thin-walled tubular member disposed within the pressure housing, the thin-walled tubular member including opposing ends, one end sealingly engaged with the rigid end piece and the other end sealingly engaged with the compliant end piece;

one or more annular standoffs disposed between the thin-walled tubular member and the pressure housing, each standoff including at least one radially extending portion contacting the pressure housing, and a gap between the radially extending portion and the thin-walled tubular member; and a chassis disposed within the thin-walled tubular member, the chassis housing the electronics.

9. The system of claim 8, wherein the pressure housing, the rigid end piece, the compliant end piece, and the thin-walled tubular member bound a sealed chamber.

10. The system of claim 9, wherein a vacuum is formed in the sealed chamber.

11. The system of claim 10, wherein the thin-walled tubular member, the rigid end piece, and the compliant end piece bound a bore of the thin-walled tubular member, the bore isolated from the sealed chamber and receiving the chassis.

12. The system of claim 8 wherein:

each standoff support the thin-walled tubular member and comprises:

two annular ends; and a plurality of longitudinally extending support members extending between the annular ends, each support member having the least one radially extending portion compressed between the thin-walled tubular member and the pressure housing.

13. The system of claim 8, wherein an inner surface of the pressure housing is coated with a material to retard the amount of heat radiated from the inner surface.

14. The system of claim 8, wherein an outer surface of the thin-walled tubular member is coated with a material to reflect heat radiated from the pressure housing.

15. A system comprising:

a drill string suspended into a wellbore;

a drill collar positioned within the drill string, the drill collar including a bore through which a drilling fluid flows;

a mounting plate disposed within the bore of the drill collar; and a flasked pressure housing coupled to the mounting plate and suspended within the bore of the drill collar, the flasked pressure housing comprising:

an outer housing;

a rigid end piece and a compliant end piece, each fixedly coupled within opposing ends of the pressure housing;

a thin-walled inner tubular member disposed within the pressure housing, the inner tubular member including opposing ends, wherein one of the opposing ends is coupled to and in sealing engagement with the rigid end piece and the other of the opposing ends is sealingly engaged with the compliant end but free to move relative to the compliant end piece;

one or more annular standoffs disposed between the inner tubular member and the pressure housing, each standoff including at least one radially extending portion contacting the pressure housing, and a gap between the radically extending portion and the inner tubular member; and a chassis disposed within the inner tubular member, the chassis housing electronics.

16. The system of claim 15, wherein the pressure housing, the rigid end piece, the compliant end piece, and the inner tubular member bound a sealed chamber, wherein a vacuum is formed in the sealed chamber.

17. The system of claim 16, wherein the inner tubular member, the rigid end piece, and the compliant end piece bound a bore of the inner tubular member, the bore isolated from the sealed chamber and receiving the chassis.

18. The system of claim 15, wherein each standoff further comprises:

two annular ends; and a plurality of longitudinally extending support member extending between the annular ends;

wherein the at least one radially extending portion extends from one or more of the support members.

19. The system of claim 15, wherein an inner surface of the pressure housing is coated with a material to retard the amount of heat radiated from the inner surface.

20. The system of claim 15, wherein an outer surface of the inner tubular member is coated with a material to reflect heat radiated from the pressure housing.

* * * * *